United States Patent [19]

LoTurco

[11] Patent Number: 4,739,906

[45] Date of Patent: Apr. 26, 1988

[54] STORAGE BOTTLE FOR CONTACT LENS CLEANING SOLUTION HAVING A SELF CLOSING VALVE ASSEMBLY

[75] Inventor: Raymond A. LoTurco, Columbus, Ind.

[73] Assignee: Blairex Laboratories, Inc., Evansville, Ind.

[21] Appl. No.: 885,422

[22] Filed: Jul. 14, 1986

[51] Int. Cl.[4] ..... B05B 11/04

[52] U.S. Cl. ..... 222/153; 222/212; 222/484; 222/494; 222/496; 222/556; 222/562

[58] Field of Search ..... 222/94, 206, 207, 209, 222/212, 213, 215, 92, 491, 494, 511, 544, 545, 547, 564, 495, 496, 497, 153, 512, 513, 514, 519, 520, 522, 525, 402.24, 562, 556, 543, 484; 137/508, 853, 859; 220/256

[56] References Cited

U.S. PATENT DOCUMENTS

| | | | |
|---|---|---|---|
| 1,911,616 | 5/1933 | Gruber | 222/492 |
| 1,987,156 | 1/1935 | Paparello | 222/494 |
| 2,025,810 | 12/1935 | Dinnes | 222/494 |
| 2,128,035 | 8/1938 | Boetel | 222/92 |
| 2,556,571 | 6/1951 | Bobbs et al. | 222/494 X |
| 2,628,004 | 2/1953 | Schlicksupp | 222/493 |
| 2,785,841 | 3/1957 | Westgate | 222/545 |
| 3,220,618 | 11/1965 | Lodding et al. | 222/543 X |
| 3,321,114 | 5/1967 | Croyle | 222/514 X |
| 3,527,551 | 9/1970 | Kutik et al. | 137/853 X |
| 3,602,407 | 8/1971 | Grothoff | 222/494 |
| 4,061,254 | 12/1977 | Nilson | 222/494 |
| 4,112,971 | 9/1978 | Nilson | 222/494 X |
| 4,141,474 | 2/1979 | Nilson | 222/494 X |
| 4,141,475 | 2/1979 | Nilson | 222/494 |
| 4,253,588 | 3/1981 | Lester et al. | 222/494 X |
| 4,349,134 | 9/1982 | Schuster et al. | 222/212 |
| 4,474,314 | 10/1984 | Roggenburg, Jr. | 222/494 |
| 4,506,809 | 3/1985 | Corsette | 222/213 |
| 4,519,530 | 5/1985 | Schmidt | 222/494 |
| 4,699,300 | 10/1987 | Blake | 222/494 |

FOREIGN PATENT DOCUMENTS

| | | | |
|---|---|---|---|
| 0172711 | 2/1986 | European Pat. Off. | 222/494 |
| 1586697 | 6/1967 | Fed. Rep. of Germany | 222/494 |
| 2362346 | 6/1974 | Fed. Rep. of Germany | 222/543 |
| WO82/00128 | 1/1982 | World Int. Prop. O. | 222/213 |
| 1157573 | 7/1969 | United Kingdom | 137/859 |
| 2106480 | 4/1983 | United Kingdom | 222/544 |

*Primary Examiner*—Joseph J. Rolla
*Assistant Examiner*—Edward S. Ammeen
*Attorney, Agent, or Firm*—Woodard, Emhardt, Naughton, Moriarity & McNett

[57] ABSTRACT

A plastic squeeze bottle has a dispensing end having a central, closed-ended, cone-shaped portion which serves as a stem or core for a valve assembly which includes an elastomeric seal which overlies and resiliently grips and circumferentially seals around the stem. The seal also covers apertures in the bottle end adjacent the stem. A small central aperture in the seal where it overlies the closed end of the stem, enables dispensing contents from the bottle when the bottle is squeezed, as the resulting internal pressure causes the seal to balloon slightly away from the stem and permit passage of saline solution from the bottle through the bottle end apertures and seal central aperture. When the squeezing stops, the seal resiliently retracts against the stem and closes the bottle. A snap-on overcap assembly has seal control and closure maintenance features to avoid accidental dispensing of bottle contents due to unintentional squeezing of the bottle when the overcap is closed.

19 Claims, 4 Drawing Sheets

STORAGE BOTTLE FOR CONTACT LENS CLEANING SOLUTION HAVING A SELF CLOSING VALVE ASSEMBLY

BACKGROUND OF THE INVENTION

This invention relates generally to dispensing bottles, and more particularly to a bottle for storing and dispensing contact lens cleaning solution.

A normal procedure for the user of contact lenses, is to periodically remove the lenses and clean them. For this purpose, a sterile solution is used. In order to avoid contamination of the solution by bacteria, a preservative is used in it. The problem with the preservative is the fact that, since the lenses are not dry when inserted in the eye, the cleaning solution remains on them and the preservative in it can irritate the eyes.

One answer to the problem has been to eliminate the preservative from the lens cleaning solution. In order to avoid contamination of the solution with the passage of time, which would otherwise occur in the absence of a preservative, the solution has been packaged in small, single-use bottles. But that approach has not been entirely convenient or economical. The present invention is addressed to the need for a convenient, economical packaging of contact lens solutions which enables the elimination of preservatives, facilitates dispensing in droplets, and avoids contamination of the solution with the passage of time.

An object of the invention is to provide a liquid storage and dispensing device which can dispense droplets or a slow stream of liquid having the viscosity of water, and which will not permit air contact with the undispensed portion of the liquid or trap dispensed liquid that would be exposed to bacteria in the air. A further object of the invention is to provide a device which is self-closing once the liquid has been dispensed.

DESCRIPTION OF THE RELATED ART

The closest prior art of which I am aware is in the form of United States patents as follows:

| U.S. Pat. No. | Inventor | Issue Date |
|---|---|---|
| 1,911,616 | Gruber | May 30, 1933 |
| 1,987,156 | Paparello | Jan. 8, 1935 |
| 2,025,810 | Dinnes | Dec. 31, 1935 |
| 2,128,035 | Boetel | Aug. 23, 1938 |
| 2,556,571 | Bobbs et al. | June 12, 1951 |
| 2,628,004 | Schlicksupp | Feb. 10, 1953 |
| 3,321,114 | Croyle | May 23, 1967 |
| 3,602,407 | Grothoff | Aug. 31, 1971 |
| 4,061,254 | Nilson | Dec. 6, 1977 |
| 4,112,971 | Nilson | Sep. 12, 1978 |
| 4,141,474 | Nilson | Feb. 27, 1979 |
| 4,141,475 | Nilson | Feb. 27, 1979 |
| 4,253,588 | Lester et al. | Mar. 3, 1981 |
| 4,474,314 | Roggenburg | Oct. 2, 1984 |

The Dinnes patent discloses a closure for collapsible tubes and which has a resilient centrally apertured plate sprung so that it is substantially concave in its normally closed configuration, covering an opening to the contents of the tube. Pressure applied to the collapsible tube causes the plate to spring outwardly to a convex shape, thereby allowing the fluid contents to be discharged. Bobbs et al discloses a similar device with the additional feature of means to permit the valve to dispense a measured quantity of fluid. Similar diaphragm means opened by pressure from the interior of the bottle or container are disclosed in patents issued to Schlicksupp, Nilson, Lester, and Boetel. Boetel further suggests a valve comprised of a tapering nozzle normally engaged upon and substantially enclosing an apertured tapering closure member. The nozzle is formed upon a resilient plate. Therefore, the Boetel disclosure contemplates that the nozzle be engaged and disengaged from the closure member by the diaphragm action of the resilient plate. The Nilson devices are similar in this respect.

None of the mentioned patents appear to disclose or suggest means suitable to store and dispense fluids such as contact lens cleaning solution in a readily and precisely controlled manner and exclude air from contact with the store solution.

SUMMARY OF THE INVENTION

Described briefly, according to a typical embodiment of the present invention, a plastic bottle is provided with a uniquely shaped neck and top having a central, cone-shaped portion which serves as a core for a valve assembly which includes an elastomeric seal, which overlies the cone. Apertures in the bottle top around the cone and under the seal enable dispensing contents from the bottle through a small central aperture in the seal where it overlies the cone. In the absence of internal pressure in the bottle, the seal resiliently retracts against the cone and closes the bottle. An overcap is provided as a snap-on to the bottle, with seal control and closure maintenance provisions to avoid accidental dispensing of bottle contents due to unintentional squeezing of the bottle when the overcap is in closed position.

DESCRIPTION OF THE PREFERRED EMBODIMENT

Figure 2:
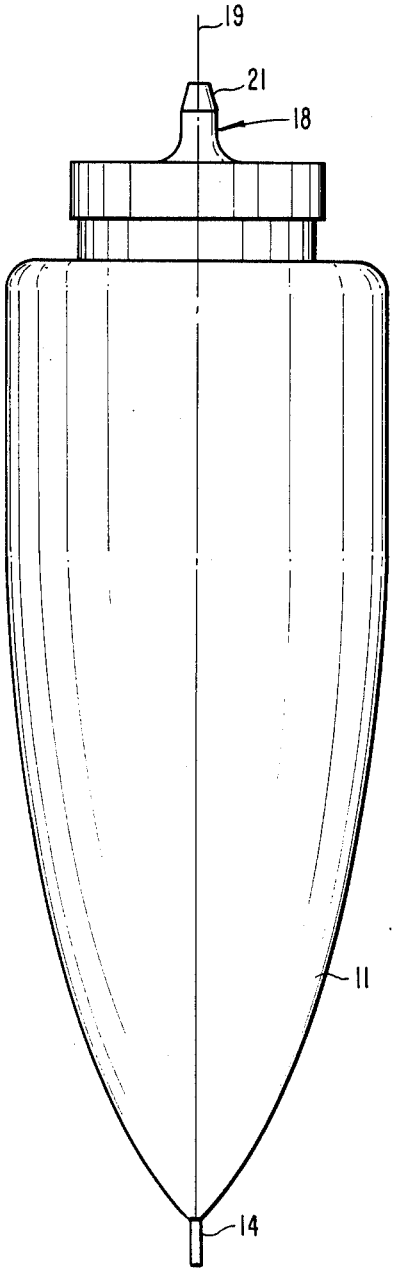
FIG. 2 is a side elevational view of the bottle portion thereof.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 1:
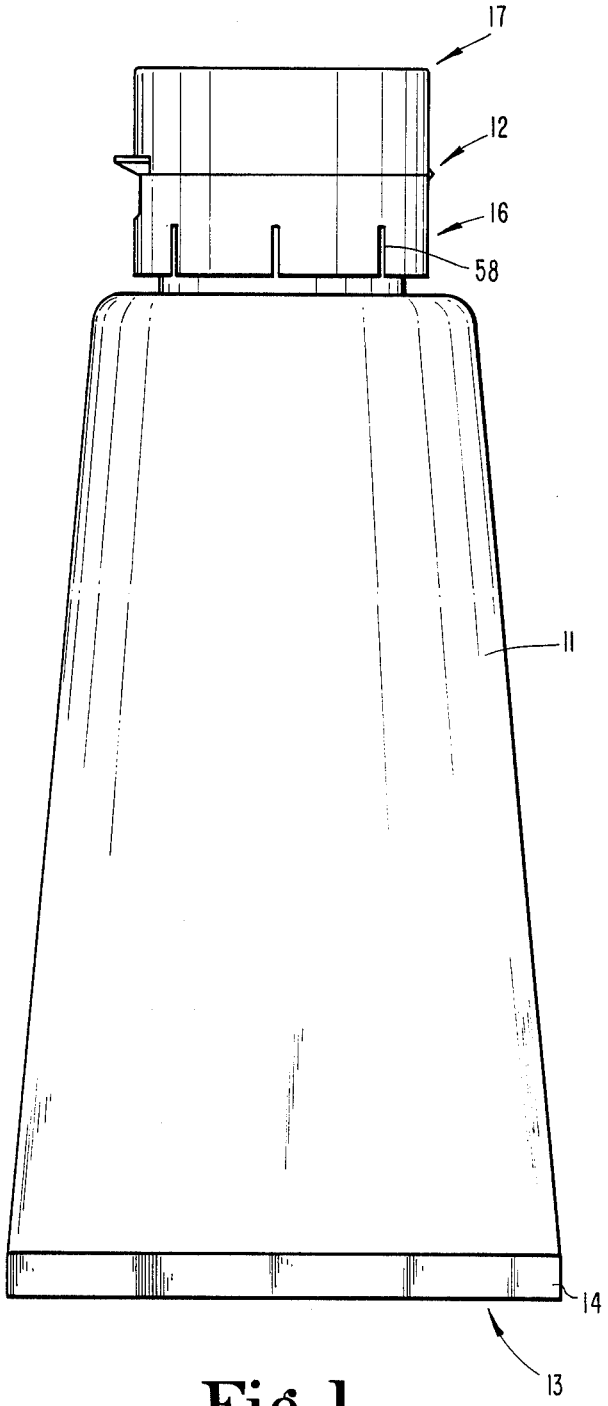
FIG. 1 is a front elevational view of a bottle assembly according to a typical embodiment of the present invention.
Figure 3:
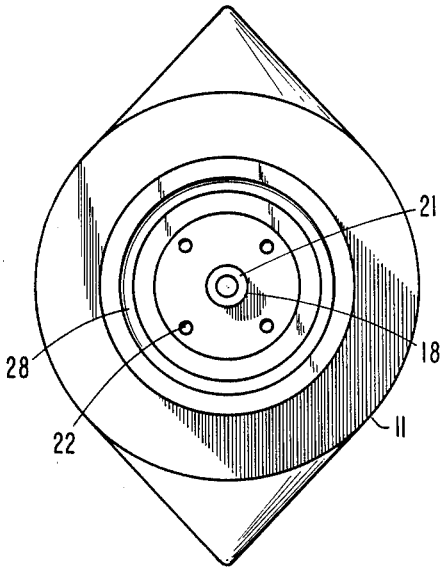
FIG. 3 is a dispensing end view of the bottle portion thereof.
Figure 4:
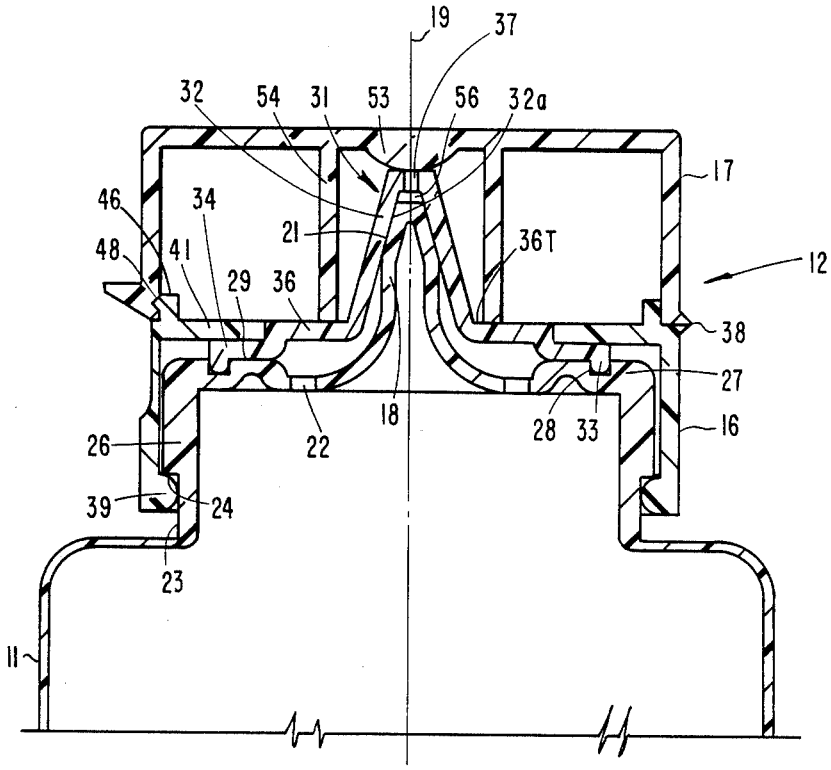
FIG. 4 is a fragmentary longitudinal section through the bottle assembly of FIG. 1, the section being taken on the plane containing the axis of the bottle assembly.

Referring now to the drawings in detail, and particularly FIGS. 1 and 4, a squeeze bottle 11 is formed with a dispensing end portion 12 and filling end portion 13, the latter normally being open until the bottle is filled with a 0.9% normal saline solution, and then hermetically sealed along the end margin 14 as shown in FIGS. 1 and 2, and then sterilized by gamma radiation. An overcap assembly is secured to the end of the bottle and includes a cap 17 and a cap retaining ring 16. As shown in FIGS. 2 and 3, the dispensing end of the bottle is formed with a stem 18 centered on axis 19 and having a conical end 21. Four apertures 22 are spaced in a circle around the stem 18.

Referring now to FIG. 4, it can be seen that the bottle is molded with a relatively thin wall up to the neck 23, which is considerably thicker, and steps out at the flange 24. Accordingly, the flanged portion 26 and head 27 are relatively thick. A seal receiver groove 28 is formed in the end, and a seal support surface 29 is provided radially inboard of the groove 28.

The seal 31 is symmetrical about the axis 19. It is a soft, supple membrane type of material of an elastomeric nature. An example is a product marketed as (KRAYTON No. 2705), White, by Shell Chemical Company and approved by the Food and Drug Administration. The normal configuration of the seal is as shown in FIG. 4 where it has a conical portion 32, a locating rib portion 33, a mounting ring portion 34, and an intermediate control portion 36. The conical portion has an included angle of 30° (15° from axis 19) as does the conical portion 21 of the stem 18. Accordingly, there is a conical area of abutting elastic circumferential gripping engagement of the inner wall 32*a* of the seal with the conical portion 21 of the stem and which normally seals the bottle closed, air tight. The seal has an aperture 37 at its center.

The overcap includes the retaining ring 16 and cap 17 secured together by an integral "living" hinge 38. The cap retaining ring includes the inwardly directed circumferential bead 39 securing the skirt of the cap under the circumferential flange 24 of the bottle end. The retaining ring 16 includes the seal retainer flange 41 which sandwiches the seal mounting ring portion 34 against the seal support face 29 of the bottle end. An axially extending, cap stabilizing flange 46 is at the top of the retaining ring and has a cap latching ridge 48 projecting outwardly from it at a location diametrically opposite the cap hinge. The cap support shoulder 49 provides support for the cap 17 around its perimeter when the cap is closed with the bottom 51 of the cap wall resting upon the shoulder 49 and the notch 52 on the inner wall of the cap receiving the rib 48 on the retaining ring to latch the cap closed as in FIG. 4.

A spherical protuberance 53 at the inside center of the cap, abuts the apertured end of the seal when the cap is closed, and closes the hole 37 in the end of the seal. There is a cylindrical flange 54 inside the cap, centered on the axis, as is the center of the protuberance 53. This flange 54 engages the top surface 36T of the intermediate portion of the seal. The combination of this flange and the protuberance 53, both acting on and confining the seal, keep it closed when the cap is closed, even if there is some pressure applied to the squeeze bottle which would otherwise dispense fluid from the container. Consequently, no fluid can get out and no air can get in. The closure of the hole 37 by the protuberance 53 prevents loss of any fluid which might be trapped in the space 56 at the end of the valve stem, and minimizes access of air to that space. Consequently, airborne bacteria is totally eliminated from the interior of the seal.

Figure 5:
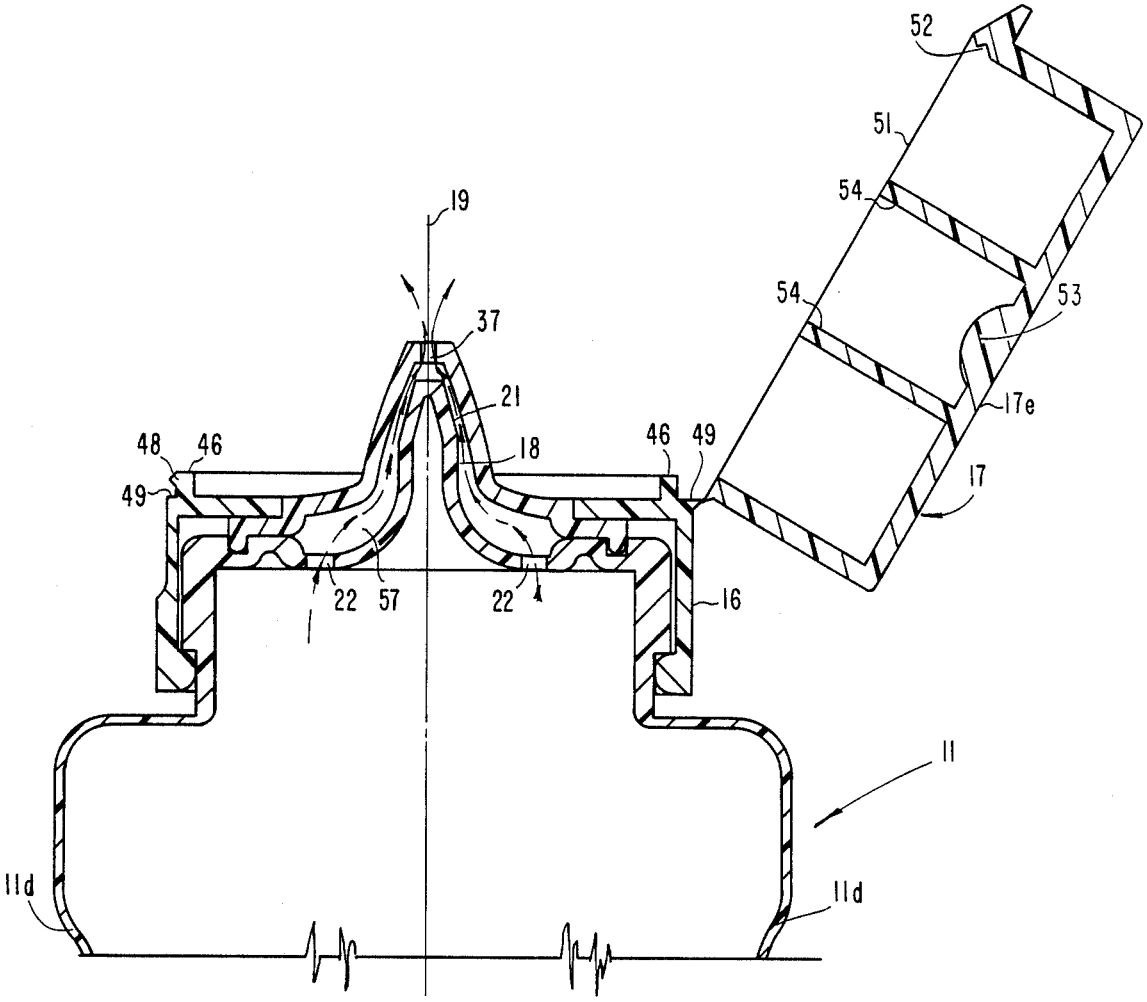
FIG. 5 is a fragmentary longitudinal section like FIG. 4 but showing the cap open and the bottle being squeezed with the valve seal thereby moved to position for dispensing contents.

Referring now to FIG. 5, the assembly is shown in the dispensing condition. Although it might not normally be used to dispense contents in the vertical direction, particularly upward, it is shown that way in this illustration for convenience. The application of dispensing pressure to the bottle wall is shown in an exaggerated sense by the deformed portion 11*d* of the wall as could be done by manual squeezing. When this is done, pressure inside the container causes the seal to balloon and to move away from the conical portion 21, as shown in FIG. 5, whereupon the liquid can be dispensed through apertures 22 and the chamber 57 and the hole 37 in the end of the seal as shown by the arrowed lines. Because the seal is resilient, it will move away sufficiently to respond to the pressure and permit dispensing of the contents. Thus it serves as a resilient nozzle. As little pressure as desired can be used, which will permit a very small separation of the seal from the cone 21 whereupon the liquid can be dispensed a drop at a time, even if its viscosity is as low as that of water. Consequently, a saline or other type of cleaning solution can be readily dispensed from this bottle assembly either in the form of a stream or in a drop-by-drop manner. As soon as the pressure is released sufficiently for the resilience of the seal to pull it back against the cone, the dispensing will terminate. The memory of the seal will pull it tight against and conforming to the surface of the cone 21, thus closing the valve.

Although the bottle wall is collapsible to dispense contents, the memory of the bottle material may tend to restore the bottle to its original configuration. To the extent original configuration is restored, it will facilitate return of the seal onto the core to close the valve and thus avoid any tendency of the valve to continue to leak even though squeezing force on the bottle has been removed. Accordingly, there would be no oozing or otherwise further dispensing of liquid following the release of the externally applied squeezing force from the bottle. However, the nozzle member material itself has sufficient resilience and restoring force due to its memory, to return to air-tight circumferential gripping of the cone 21 independent of any bottle configuration restoring function of the bottle material memory. There is no opportunity for air to enter the chamber 57 at all. Because of the small space involved in the aperture 37 and chamber 56, there is virtually no possibility of air entering that small space following the release of pressure, even if the bottle is nozzle down. In any case, the opening 37 is closed by the protuberance 53 on the cap as soon as the cap is snapped closed. Also, upon the next occasion for dispensing solution, a slight amount of the contact lens cleaning solution is preferably dispensed to waste, to flush the space 56 and opening 37, before dispensing solution onto lenses or into lens storage cups.

The flat end 17*e* on the cap, and its large area, facilitate standing the bottle on its cap, when not in use.

For purposes of example only for the illustrated embodiment, and not by way of limitation, the typical size of the holes 22 is 0.094 inches. That for the hole 37 is 0.062 inches. The outside diameter of the cap is 1.828 inches. There are eight circumferentially spaced slots 58 which are 0.031 inch wide in the skirt of the cap retaining ring to enable it to snap over the thick wall portion 26 of the bottle neck whereupon the retaining rib 39, having a free inside diameter of 1.578 inches, can snap into the groove or reduced neck wall 23 having a diameter of 1.578 inches. The typical wall thickness of the bottle at the thin wall portion is 0.020 inches. The material of the bottle is a very low density polyethylene (VLDPE) by Union Carbide Corporation in a white opaque color, as approved by the Food and Drug Administration. The material of the overcap is a high density polyethylene (HDPE) as marketed by Phillips Petroleum Co. as their TR 880 co-polymer.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A self-closing bottle assembly for the controlled dispensing of fluid, comprising:

a collapsible bottle for receiving and containing fluid within, having a body and a neck at one end of said body and a head at the end of the neck with a nozzle retainer groove and a seal support surface therein, said neck having a central axis, and the groove and seal support surface being circular and centered on said axis and located at a plane perpendicular to said axis, with the support surface extending radially inward from the groove, said bottle having first discharge outlet means radially inward from said support surface, whereby said fluid is dispensed hydraulically from the interior of said bottle through said first discharge outlet means upon the application of an external collapsing force to the exterior of said bottle;

self-closing valve means on said neck, said valve means comprising;

valve stem means including a tapering projection on said body adjacent said first discharge outlet means and projecting outwardly from said body;

a resilient nozzle member on said bottle normally closing said first discharge outlet means and so located to substantially enclose said valve stem means, said nozzle member having a resilient base region, said base region having an outer marginal portion and formed at its interior into a hollow central portion projecting outwardly from said body and converging as it projects outwardly to an end of said hollow central portion, said central portion having second discharge outlet means at said end, said central portion being so designed and situated to seat in immediate contact with and elastically grip said tapering projection when in a closed position to produce an air-tight seal, and to balloon outwardly from said tapering projection when enough fluid pressure is applied to the interior surface of said hollow central portion of said nozzle member, and then to resiliently return to said closed position when the fluid pressure is relieved; and means for securely engaging said resilient nozzle member with said groove and seal support surface and operable to compress said outer marginal portion of said base region of said nozzle member against said seal support surface to provide an air-tight seal.

2. The self-closing bottle assembly of claim 1, wherein said means for securely engaging said resilient nozzle member with said groove and seal support surface comprises:

a retaining ring mounted on said neck of said bottle, having a flange directed radially inward from an inner circumferential surface of said retaining ring, said flange being so situated and designed to abuttingly contact said outer marginal portion of said base region of said nozzle member and to secure the base region in pressed engagement with said seal support surface.

3. The self-closing bottle assembly of claim 2 wherein;

an upper marginal portion adjacent said end of said hollow central portion of said nozzle member is slightly beyond the end of said tapering projection, and said bottle assembly further comprises a locking cap secured to said retaining ring, said cap being so designed and situated to abuttingly engage and resiliently compress said end of the hollow central portion and to cover said second discharge outlet means when said cap is in a closed position to form an air-tight seal, with means to lock said cap in the closed position.

4. The self-closing bottle assembly of claim 3 wherein:

said locking cap further comprises a flat outer surface on which to balance and bear the weight of said bottle when resting on a substantially flat surface, when said cap is in the closed position.

5. The self-closing bottle assembly of claim 2, wherein said means for securely engaging said resilient nozzle member with said groove and seal support surface further comprises means for providing an air-tight interlocking seal between the nozzle member and the seal support surface;

wherein said means for providing an air-tight interlockingg seal includes said neck having a circumferential shoulder, and said retaining ring having an inwardly directed circumferential flange adapted to mate with said shoulder in a snap-fit relationship.

6. The self-closing bottle assembly of claim 5, wherein said first discharge outlet means comprises a plurality of apertures, each of said apertures located within said means for providing an air-tight interlocking seal.

7. The self-closing bottle assembly of claim 1 wherein:

the head and neck of the bottle are thick relative to the body of the bottle;

an upper marginal portion adjacent said end of said hollow central portion of said nozzle member extends slightly beyond said tapering projection, and said bottle assembly further comprises an overcap assembly, secured to said neck, so designed and situated to abuttingly engage and resiliently compress said upper marginal portion of the hollow central portion and thereby close said second discharge outlet means, when in a closed position to form an air-tight seal, with means to lock said overcap assembly in said closed position, and with further means to disengage said overcap assembly from said upper marginal portion and to expose said second discharge outlet means, when the overcap assembly is in an open position.

8. The self-closing bottle assembly of claim 7 wherein:

said overcap assembly further has a flat outer surface on which to balance and bear the weight of said bottle when resting on a substantially flat surface, when said overcap assembly is in the closed position.

9. The self-closing bottle assembly of claim 1, wherein:

said second discharge outlet means is of sufficiently small diameter to provide a metered droplet discharge of fluid through said outlet means.

10. The self-closing bottle assembly of claim 9, wherein:

said second discharge outlet means is of sufficiently small diameter to provide a single droplet discharge when a first external collapsing force is applied to said collapsible bottle, while allowing a continuous stream discharge of fluid through said outlet means when a sufficiently larger second external collapsing force is applied to said collapsible bottle.

11. The self-closing bottle assembly of claim 1, wherein:

said collapsible bottle is formed of a resilient material having a memory such that said bottle is partially restored toward its original configuration when the external collapsing force is removed; and the resilience of said nozzle member is sufficient to return said nozzle member to a condition of elastically and circumferentially gripping said tapering projection and forming an air-tight seal to seal the bottle-assembly closed upon removal of said collapsing force and independently of any configuration restoring effect of the bottle material memory.

12. The self-closing bottle of claim 1 wherein said resilient nozzle member is composed of an elastomeric material having a memory for a normal free shape.

13. The self-closing bottle assembly of claim 1, wherein:

the material of said resilient nozzle member has resilience equivalent to that of an elastomeric material;

said second discharge outlet means is an outlet aperture having an area substantially equal to that of a circle of 0.062 inch diameter; and said collapsible bottle is filled with a saline solution.

14. The self-closing bottle assembly of claim 1, wherein said first discharge outlet means comprises a plurality of apertures.

15. A self-closing bottle assembly for the controlled dispensing of fluid, comprising:

a collapsible bottle for receiving and containing fluid within, having a body and a neck at one end of said body, said neck having first discharge outlet means, whereby said fluid is dispensed hydraulically from the interior of said bottle through said first discharge outlet means upon the application of an external collapsing force to the exterior of said bottle;

self-closing valve means on said neck, said valve means comprising;

valve stem means including a tapering projection on said body adjacent said first discharge outlet means and projecting outwardly from said body;

a resilient nozzle member on said neck normally closing said first discharge outlet means and so located to substantially enclose said valve stem means, said nozzle member having a resilient base region and having a discharge end, said base region having an outer marginal portion and an intermediate portion, said nozzle member being formed at its interior into a hollow central portion projecting outwardly from said body and tapering from said base region in a converging manner as it projects outwardly to said discharge end to form a hollow frustum, said central portion having a second discharge outlet means at said discharge end and having an upper marginal portion adjacent said discharge end and extending slightly beyond the end of said tapering projection of said body and seated in immediate contact with and elastically gripping said tapering projection when in a closed position to produce an air-tight seal, and said central portion being operable to balloon outwardly from said tapering projection when enough fluid pressure is applied to the interior surface of said hollow central portion of said nozzle member, and then to resiliently return to said closed position when the fluid pressure is relieved; and means for securely engaging said resilient nozzle member with said neck, wherein said means includes;

a retaining ring mounted on said neck of said bottle, having a flange directed radially inward from an inner circumferential surface of said retaining ring, said flange compressing said outer marginal portion of said base region of said nozzle member and securing the base region in pressed engagement with said neck to provide an air-tight seal, said retaining ring including a radially outwardly projecting ridge in an upper perimetrical portion of said ring; and a locking cap secured to said retaining ring, with means to lock said cap in a closed position, wherein said locking cap includes;

a cover portion having a protuberance projecting inwardly toward said bottle when said cap is in the closed position, and arranged to abuttingly engage and resiliently compress said upper marginal portion of said hollow central portion when said cap is in the closed position to substantially close and seal said second discharge outlet means, said cover portion further having a cylindrical flange projecting inwardly toward said bottle when said cap is in the closed position, and arranged to abuttingly engage said base region of said nozzle member near said hollow frustum to elastically pull said hollow frustum against said tapering projection on said valve stem means when the cap is in the closed position.

said cover portion further having an notch opposing said ridge in said retaining ring when the cap is in the closed position and receiving said ridge, when the cap is in the closed position, hinge means diametrically opposite said notch, hingedly connecting said retaining ring and said cover portion, wherein said hinge means coacts with said notch when receiving said ridge to tightly restrain said cover portion against said retaining ring, when the cap is in the closed position, said hinge means coacts with the notch when receiving the ridge, and with said protuberance to firmly engage said upper marginal portion of said hollow central portion, when the cap is in the closed position, and said hinge means coacts with the notch when receiving the ridge, to hold said cap with said cylindrical flange firmly engaging said base region of the nozzle member near the hollow frustum when the cap is in the closed position.

16. The self-closing bottle assembly of claim 15, wherein said hinge means comprises:

a living hinge integral with said cover portion and said retaining ring;

said living hinge having a natural resistance to hinged rotation when said cap is in the closed position;

said living hinge having a natural resistance to hinged rotation when said cap is in an open position; and said living hinge smoothly hingedly rotates between said closed and open positions.

17. A self-closing bottle assembly for the controlled dispensing of fluid, comprising;

a collapsible bottle for receiving and containing fluid within, having a body and a neck at one end of said body, said neck having first discharge outlet means, whereby said fluid is dispensed hydraulically from the interior of said bottle through said first discharge outlet means upon the application of an external collapsing force to the exterior of said bottle;

self-closing valve means on said neck, said valve means comprising;

valve stem means including a tapering projection on said body adjacent said first discharge outlet means and projecting outwardly from said body;

a resilient nozzle member on said neck normally closing said first discharge outlet means and so located to substantially enclose said valve stem means, said nozzle member having a resilient base region and having a discharge end, said base region having an outer marginal portion and an intermediate portion, said nozzle member being formed at its interior into a hollow central portion projecting outwardly from said body and converging as it projects outwardly to said discharge end, said central portion having second discharge outlet means at said discharge end and having an upper marginal portion adjacent said discharge end and extending slightly beyond said tapering projection and seated in immediate contact with and elastically gripping said tapering projection when in a closed position to produce an air-tight seal, and said central portion being operable to balloon outwardly from said tapering projection when enough fluid pressure is applied to the interior surface of said hollow central portion of said nozzle member, and then to resiliently return to said closed position when the fluid pressure is relieved;

means for securely engaging said resilient nozzle member with said neck and operable to compress said outer marginal portion of said base region of said nozzle member against said neck to provide an air-tight seal; and an overcap assembly, secured to said neck, and abuttingly engaging and resiliently compressing said discharge end of said central portion and thereby closing said second discharge outlet means, when in a closed position to form an air-tight seal, with means to lock said overcap assembly in said closed position, and with further means to disengage said overcap assembly from said discharge end and to expose said second discharge outlet means, when the overcap assembly is in an open position, said overcap assembly including, a retaining ring mounted on said neck of said bottle, and having a radially outwardly projecting ridge in an upper perimetrical portion of said ring;

a cap comprising, a protuberance projecting inwardly toward said bottle when said cap is in a closed position, and arranged to abuttingly engage and resiliently compress said discharge end of said hollow central portion when said cap is in the closed position to substantially close and seal said second discharge outlet means, a cylindrical flange projecting inwardly toward said bottle when said cap is in the closed position, and arranged to abuttingly engage said base region of said nozzle member near the tapering projection to elastically pull said central portion over said tapering projection on said valve stem means when the cap is in the closed position, a notch opposing said ridge in said retaining ring when the cap is in the closed position and receiving said ridge when the cap is in the closed position; and hinge means diametrically opposite said notch, hingedly connecting said retaining ring and said cap, wherein:

said hinge means coacts with said notch when receiving said ridge to tightly restrain said cap against said retaining ring, when the cap is in the closed position, said hinge means coacts with the notch when receiving the ridge, and with said protuberance to firmly engage said discharge end of said hollow central portion of said nozzle member, when the cap is in the closed position, and said hinge means coacts with the notch when receiving the ridge, to hold said cap with said cylindrical flange firmly engaging said base region of the nozzle member near the tapering projection when the cap is in the closed position.

18. The self-closing bottle assembly of claim 17, wherein said hinge means comprises:

a living hinge integral with said cap and said retaining ring;

said living hinge having a natural resistance to hinged rotation when said cap is in the closed position;

said living hinge having a natural resistance to hinged rotation when said cap is in the open position; and said living hinge smoothly hingedly rotates between said closed and open positions.

19. A self-closing bottle assembly for the controlled dispensing of fluid, comprising:

a collapsible bottle for receiving and containing fluid within, having a body and a neck at one end of said body, said neck having first discharge outlet means, whereby said fluid is dispensed hydraulically from the interior of said bottle through said first discharge outlet means upon the application of an external collapsing force to the exterior of said bottle;

self-closing valve means on said neck, said valve means comprising;

valve stem means including a tapering projection on said body adjacent said first discharge outlet means and projecting outwardly from said body;

a resilient nozzle member on said neck normally closing said first discharge outlet means and so located to substantially enclose said valve stem means, said nozzle member having a resilient base region and a discharge end, said base region having an outer marginal portion and an intermediate portion, said nozzle member being formed at its interior into a hollow central portion projecting outwardly from said body and converging as it projects outwardly to said discharge end, said central portion having second discharge outlet means at said discharge end, said central portion being seated in immediate contact with and elastically gripping said tapering projection when in a closed position to produce an air-tight seal, and said central portion being operable to balloon outwardly from said tapering projection when enough fluid pressure is applied to the interior surface of said hollow central portion of said nozzle member, and then to resiliently return to said closed position when the fluid pressure is relieved; and means for securely engaging said resilient nozzle member with said neck and operable to compress said outer marginal portion of said base region of said nozzle member against said neck to provide an air-tight seal, including;

a retaining ring mounted on said neck of said bottle, having a flange directed radially inward from an inner circumferential surface of said retaining ring, said flange abuttingly contacting said outer marginal portion of said base region of said nozzle member and securing the base region in pressed engagement with said neck; and means for providing an air-tight interlocking seal between the nozzle member and the neck, and comprising:

a support face on said bottle and projecting radially inward from the uppermost portion of the neck, said first discharge outlet means and said tapering projection being inboard from said support face, and, said support face providing a sealing surface situated to form a continuous perimeter surrounding the first discharge outlet means and the tapering projection, and said support face further including a continuous seal groove adjacently parallel and outboard of said sealing surface;

a circumferential locating rib formed in said outer marginal portion of said base region of said nozzle member, said rib being directed downward toward said body and in opposing juxtaposition with said seal groove; and said outer marginal portion of the base region being in overlapping contact with the support face, and the locating rib being receivingly engaged within the seal groove, to provide a tight seal when said flange directed radially inward from said retaining ring is in abutting engagement with the outer marginal portion of the base region.

* * * * *